US005579645A

United States Patent [19]

Prociw et al.

[11] Patent Number: 5,579,645

[45] Date of Patent: Dec. 3, 1996

[54] RADIALLY MOUNTED AIR BLAST FUEL INJECTOR

[75] Inventors: Lev A. Prociw, Willowdale; Alain Bouchard, St. Charles Borromee; Pierre Bolduc, St. Amable; Honze Stastny, West St. Bruno, all of Canada

[73] Assignee: Pratt & Whitney Canada, Inc., Longueuil, Canada

[21] Appl. No.: 523,906

[22] Filed: Sep. 6, 1995

Related U.S. Application Data

[63] Continuation of Ser. No. 430,600, Apr. 28, 1995, abandoned, which is a continuation of Ser. No. 69,909, Jun. 1, 1993, abandoned.

[51] Int. Cl.[6] ..... F02C 7/22; F23D 11/24

[52] U.S. Cl. ..... 60/740; 60/748; 239/404; 239/406

[58] Field of Search ..... 60/740, 742, 748, 60/743, 738; 239/404, 405, 406

[56] References Cited

U.S. PATENT DOCUMENTS

| | | | |
|---|---|---|---|
| 2,690,648 | 10/1954 | Pearce et al. | 60/739 |
| 3,516,252 | 6/1970 | Udell et al. | 60/39.74 |
| 3,684,186 | 8/1972 | Helmrich | 60/742 |
| 3,912,164 | 10/1975 | Lefebvre et al. | 60/743 |
| 4,028,888 | 6/1977 | Pilarczyk . | |
| 4,170,108 | 10/1979 | Mosby | 60/740 |
| 4,216,652 | 8/1980 | Herman et al. | 60/748 |
| 4,362,022 | 12/1982 | Faucher et al. | 60/742 |
| 4,467,610 | 8/1984 | Pearson et al. . | |
| 4,854,127 | 8/1989 | Vinson et al. | 60/743 |
| 5,031,401 | 7/1991 | Hinderks . | |

*Primary Examiner*—Timothy S. Thorpe
*Attorney, Agent, or Firm*—R. G. Henley; Jeffrey W. Astle

[57] ABSTRACT

A fuel nozzle (18) for a gas turbine engine comprises a nozzle stem (55), a nozzle tip assembly (60) and a nozzle sheath (50). A plurality of inlets (82) allow air to flow into the interior (90) of the sheath (50); fuel is flowed into the nozzle (18) through a fuel passage (135) in fluid communication with a fuel manifold. The fuel enters a fuel channel (140) defined by the stem (55) and tip assembly (60), and then passes into a fuel gallery (185) through a plurality of metering holes (190). Fuel swirls out of the tip assembly (60), where it is caught between, and squeezed by, first and second streams of air passing out of radially spaced apart air passages (145) and (220).

25 Claims, 4 Drawing Sheets

N
146
44
148
115
125
122
127
95
105
65
100
55
75
82
135
80
18
90
50
85
85
3
179
165
177
167
B
245
140
235
46
181
206
217
185
221
60
219
143
150
144
173
145
70
120
207
240
110
175
B
170
190
155
220
180
200
205
171
141
145
142
N
3

*fig.4*
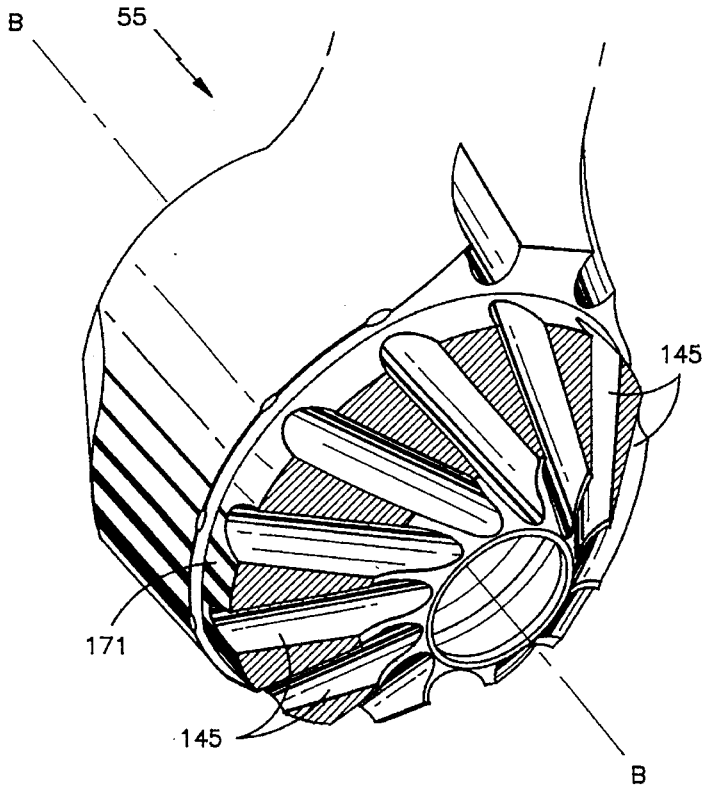
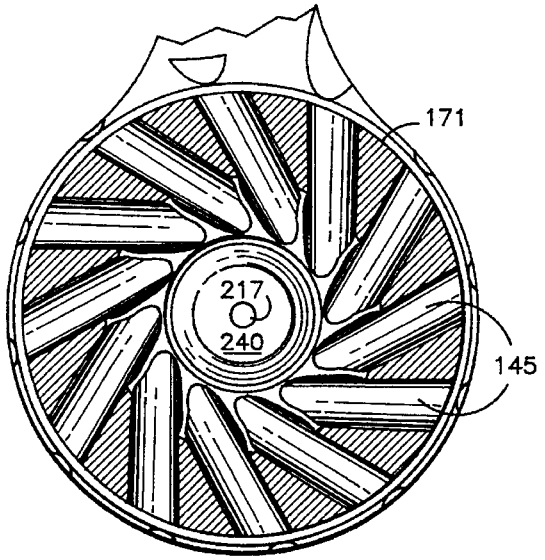
*fig.5*

RADIALLY MOUNTED AIR BLAST FUEL INJECTOR

This application is a continuation of application Ser. No. 08/430,600, filed Apr. 28, 1995, which is a continuation of Ser. No. 08/069,909 filed Jun. 1, 1993, both now abandoned.

TECHNICAL FIELD

This invention relates gas turbine engines, and in particular, to fuel nozzles for gas turbine engines.

BACKGROUND ART

Gas turbine engines are widely used to power aircraft throughout the world. The engine provides thrust which powers the aircraft by burning a mixture of fuel and air in one or more combustors. A fuel nozzle sprays such mixture into each combustor in a form suitable for rapid mixing and efficient combustion.

The most common types of fuel nozzles use a pressure atomizing principle to provide a uniform distribution of fine fuel particles, or droplets, throughout the range of fuel flow conditions encountered during engine operation. In order to be commercially useful, fuel nozzles must be able to (a) efficiently atomize fuel at low air flow rates, (b) uniformly atomize fuel at high power regimes, and (c) provide predictable and controllable fuel spray characteristics over a range of engine operating conditions. Those skilled in the art recognize that other characteristics of fuel nozzles are also desired in addition to those enumerated above.

While progress has been made in designing fuel nozzles for gas turbine engine use, further improvements are required. The present invention provide such improvements.

SUMMARY OF THE INVENTION

The fuel nozzle according to this invention has an upstream end, a downstream end, and an axis, and is comprised of a nozzle stem, a nozzle tip, and a nozzle sheath that surrounds the stem and tip assembly; the nozzle includes first and second air passages extending in a downstream direction through the nozzle, the first air passage having an annular, radially inwardly converging cross-sectional shape, and the second air passage is defined by a plurality of circumferentially spaced apart holes extending through the stem, each of the holes spaced radially outwardly of the first air passage; the nozzle additionally comprises a fuel gallery extending in the downstream direction through the nozzle, the fuel passage having an annular cross-sectional shape defined by opposing and radially inwardly converging surfaces, the fuel gallery being spaced radially intermediate the first and second air passages; and means constructed and arranged to flow fuel into the fuel gallery at an angle substantially tangential to the surfaces defining the fuel gallery; and wherein the sheath includes inlet means for admitting air into the sheath, and outlet means for flowing air and fuel out of the sheath.

A key feature of the inventive nozzle is its ease of disassembly. Such feature allows the nozzle to be, for example, quickly cleaned and inspected, an important consideration for operators of gas turbine engines.

Other features and advantages of the present invention will be apparent from the accompanying drawings which illustrate an embodiment of the invention.

BRIEF DESCRIPTION OF THE DRAWINGS

FIG. 4 is a perspective view of the downstream end of a stem according to the invention.

FIG. 5 is a view of the downstream face of a stem according to the invention.

BEST MODE FOR CARRYING OUT THE INVENTION

Figure 1:
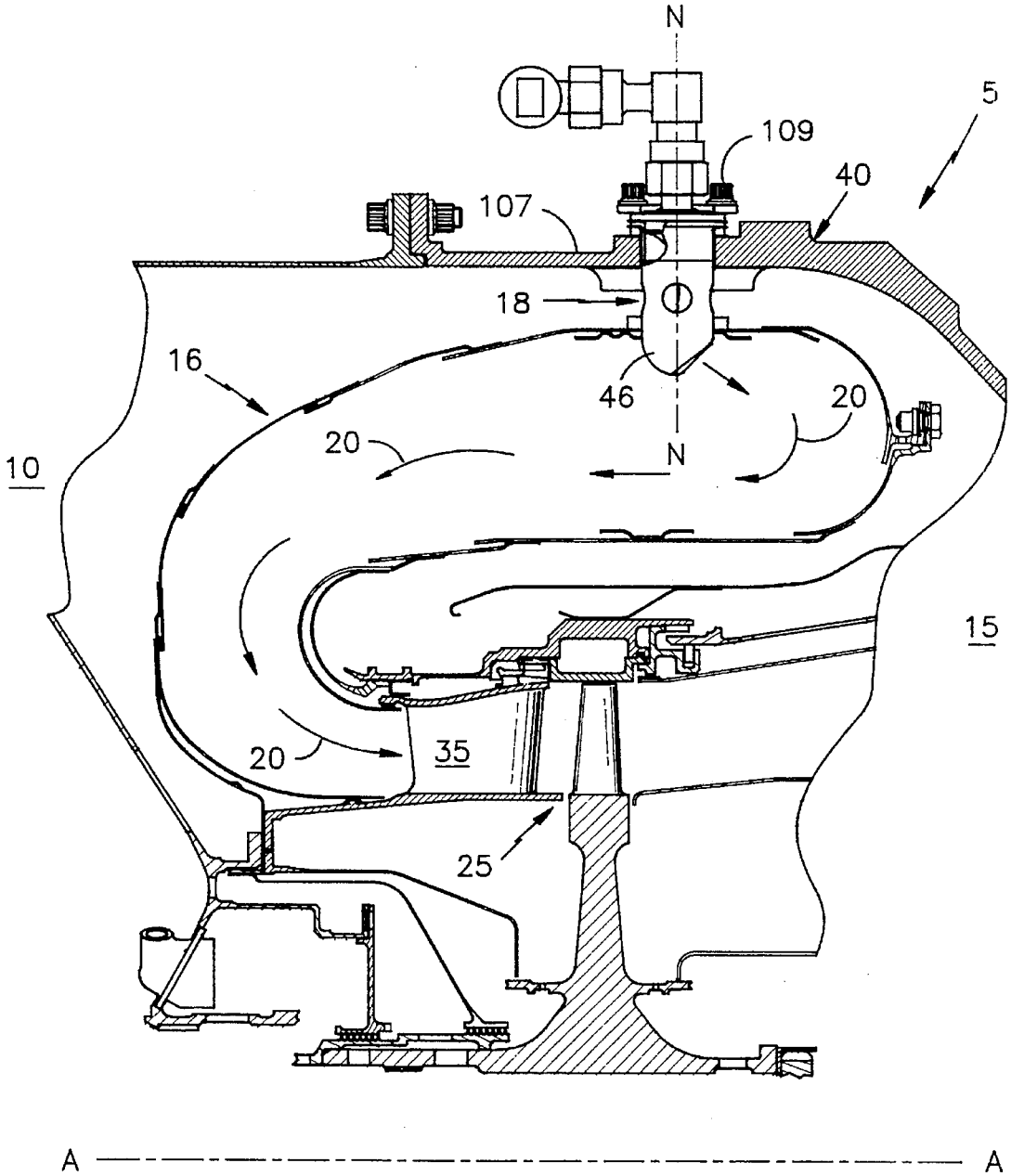
FIG. 1 is a simplified, cross-sectional view showing the combustor section of a gas turbine engine.

FIG. 1 is a simplified, cross sectional view showing the combustor section 5 of a gas turbine engine. The axis of the engine is indicated by the reference numeral A—A. The upstream end of the engine is indicated by the reference numeral 10 and the downstream end of the engine is indicated by the reference numeral 15. The key features of the combustor section 5 are the combustor 16 and the fuel nozzle 18. During operation of the engine, air and fuel flows through the nozzle 18 and into the combustor 16 in the direction generally indicated by arrows 20, and then passes into the turbine section 25 of the engine; the fuel and air mixture is ignited by an ignitor (not shown) which is proximate to the nozzle 18. The first stage of the turbine section 25 begins with a row of circumferentially spaced apart turbine vanes 35. In general, the outer boundary of the combustor section is defined by the combustor duct 40. The upstream end of the nozzle is indicated by the reference numeral 44; the downstream end by the reference numeral 46; and the nozzle axis by the lines N—N.

Figure 2:
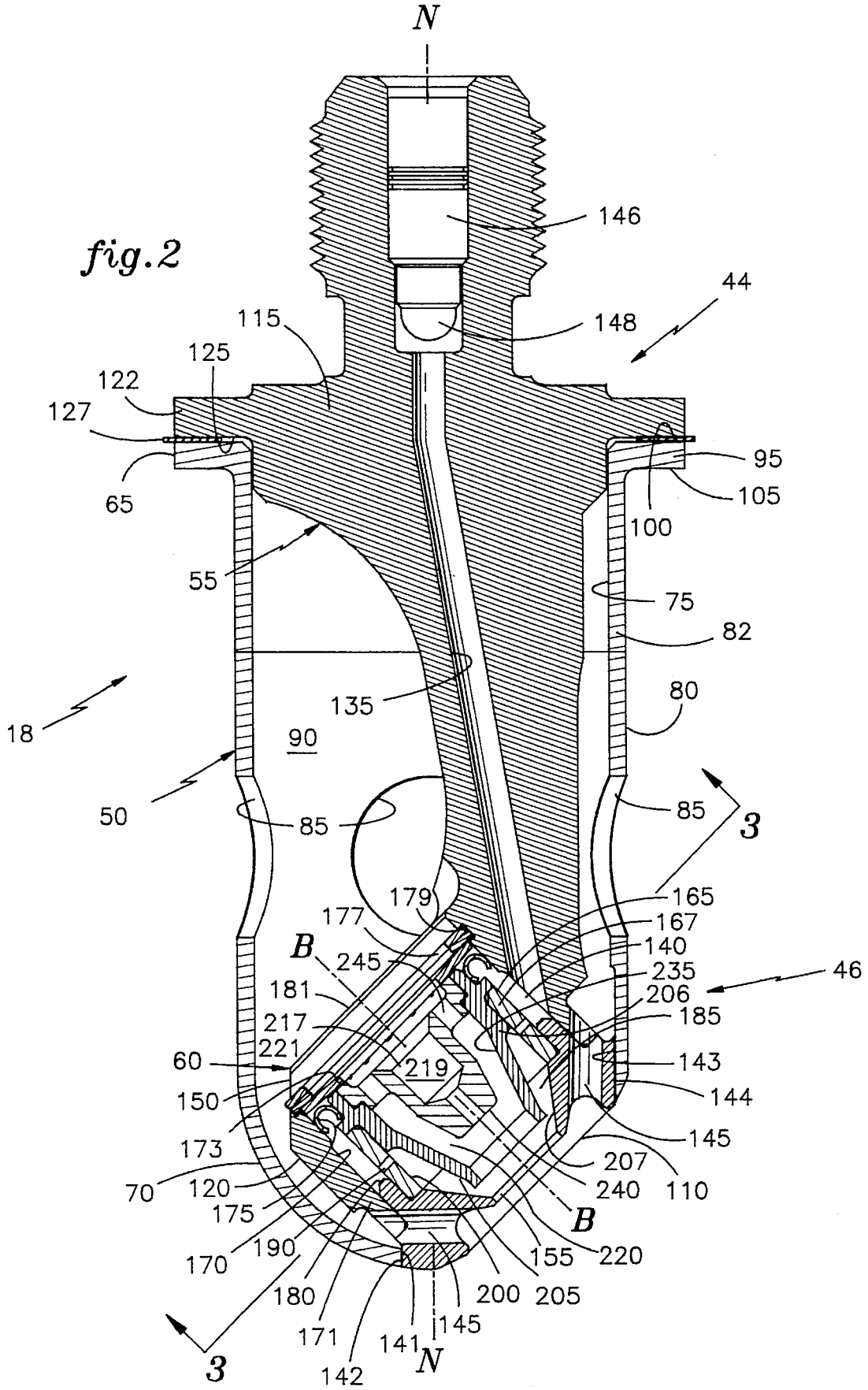
FIG. 2 is a cross-sectional view taken along the lines 2—2 of FIG. 1.

FIG. 2 is a sectional view of the nozzle 18 taken along the lines 2—2 of FIG. 1. The nozzle 18 comprises a nozzle sheath 50, a nozzle stem 55, and a tip assembly 60. The sheath 50 is cylindrical in shape, and has an upper end 65 and a lower end 70; the body of the sheath is defined by sheath wall 82, which has an inner surface 75 and an outer surface 80. An inlet 85 passes through the sheath wall 82 to admit air into the interior of the sheath 90; preferably, the sheath 50 includes at least three inlets, spaced substantially equidistant about the circumference of the sheath 50. The axis of the sheath 50 is coincident with the axis N—N of the nozzle 18.

The sheath 50 further includes a shoulder 95 at its upper end 65; the shoulder 95 has a top surface 100 and a bottom surface 105. The shoulder 95 extends outwardly from the sheath 50, and as seen in FIG. 1, the nozzle 18 is fixedly secured to the combustor duct 40 by support structure generally shown as reference numeral 109. The bottom surface 105 of the sheath 50 rests upon the outer surface 107 of the duct 40. As is also shown in FIG. 2, the sheath 50 includes a singular outlet 110 that extends through sheath wall 82 at the sheath lower end 70; as will be apparent from the description below, air and fuel passes through the outlet 110 into the combustor 16 during operation of the engine.

The nozzle stem 55 has an upper end 115 and a lower end 120. Like the sheath 50, the stem upper end 115 includes a shoulder 122; the underside surface 125 of the shoulder 122 rests upon the top surface 100 of the sheath shoulder 95. Optionally, a shim 127 is located between the surfaces 100 and 125 of the sheath and stem, respectively.

The stem 55 includes a passage 135 in fluid communication with a fuel manifold (not shown). The fuel passage 135 includes a fuel filter 146 and flow restrictor 148 for controlling the rate of fuel flow from the fuel manifold to the tip 60. Fuel flows through the passage 135 into a fuel channel 140 defined by spaced apart surfaces of the stem 55 and the tip 60. The channel 140 has an annular shape which extends about the periphery of the tip 60. The stem 55 also includes a plurality of circumferentially spaced apart outer air holes 145 which pass through the outer wall 171 of the stem, and extend through the axially downstream face of the stem 55. The air holes 145 are preferably circular in cross section, and are set at a compound angle with respect to the axis B—B of the tip 60, as is best shown in FIGS. 4 and 5. As a result of the compound angle of the air holes 145, air passing through each of the air holes 145 has an axial as well as tangential component of velocity. As is best seen in FIG. 2, axially extending surfaces of the stem 55 and sheath 50 abut each other, so as to create a fluid seal therebetween. In particular, surface 141 of the sheath 50 abuts surface 142 of the stem 55, and surface 143 of the sheath 50 abuts surface 144 of the stem 55. The abutting surfaces 141, 142, 143, 144 all extend along the axis N—N of the nozzle 18 and the sheath 50. This feature allows the stem 55 to be removed from the sheath 50, and thereby from the combustor 18, by lifting the stem 55 along the axis N—N. The entire nozzle 188 need not be separately removed from the combustor 16, as is the case with prior art nozzle designs. Using the nozzle 18 of this invention allows for easy on-wing inspection of the stem 55 and/or nozzle tip assembly 60.

The cylindrical shaped sheath 50 is machined to form an ellipsoid shaped outlet 110. The machining tool is presented to the sheath 50 parallel to the axis N—N, and follows an elliptical path to form the outlet 110. A similar process is conducted on the nozzle stem 55, so as to form surfaces 141, 142, 143, 144 that precisely abut each other when the stem 55 and sheath 50 are assembled. Once assembled, the stem 55 is sealingly and releasably engaged within the sheath 50.

Nested within the stem 55 is the fuel tip assembly 60. The tip assembly 60 has an upstream end 150 and a downstream end 155; fuel and air pass generally in the downstream direction through the tip 60 into the combustor 16, where it is ignited. As indicated above, the stem 55 and tip 60 cooperate to form a fuel channel 140 extending about the circumference of the tip 60. The inner boundary of the channel 140 is defined by the outer surface 165 of the radially outer tip wall 167, while the outer boundary of the channel 140 is defined by the inner surface 170 of the stem wall 171. The upstream extent of the channel 140 is defined by a c-shaped seal 175 which rests between the adjacent and spaced apart surfaces 165 and 170 of the stem and tip, respectively. The downstream extent of the channel 140 is defined by a radially extending projection 180 on the tip wall 167; as seen in FIG. 2, the projection 180 abuts the stem wall 171.

One of the advantages of the inventive nozzle is its ease of disassembly, and conversely, assembly. The tip 60 is sealingly and releasably engaged within the stem 55. In particular, a Belleville washer 173 and a spring clip 177 cooperate to secure the tip assembly 60 within the stem 55. The clip 177 is secured within a notch 179 which extends circumferentially about the stem 55, slightly below the top surface 181 of the tip. Optionally, the washer 173 and clip 177 could be eliminated, and the tip assembly 60 brazed or otherwise permanently attached to the stem 55. However, the brazed structure is not as easily assembled and disassembled, and for that reason, it is not the preferred embodiment of the invention.

The tip assembly 60 includes a fuel swirler gallery 185 downstream of, and radially inward of, the fuel channel 140. The gallery 185 and channel 140 are in fluid communication by means of a plurality of metering holes 190 extending therebetween. As is seen from FIG. 2, the metering holes 190 are spaced axially between the projection 180 that defines the downstream end of the fuel channel 140 and the c-shaped seal 175 that defines the upstream end of the fuel channel 140. The inner and outer boundaries of the fuel gallery 185 are defined by the surfaces of radially inwardly extending walls 167 and 206 of the tip assembly 60. In particular, and as shown in FIG. 2, the outer boundary of the gallery 185 is defined by the inner surface 200 of wall 167; the inner boundary of the gallery 185 is defined by the outer surface 205 of wall 206. The surfaces 200 and 205 converge towards each other in a radially inward direction to define the radially inwardly converging gallery 185, and an annular shaped fuel pinch point 207. In other words, the diameter of the fuel gallery 185 decreases in the downstream direction. As will be described below, at the pinch point 207, fuel flowing out of the gallery 185 is contacted by high velocity streams of air, which cause atomization of the fuel.

Figure 3:
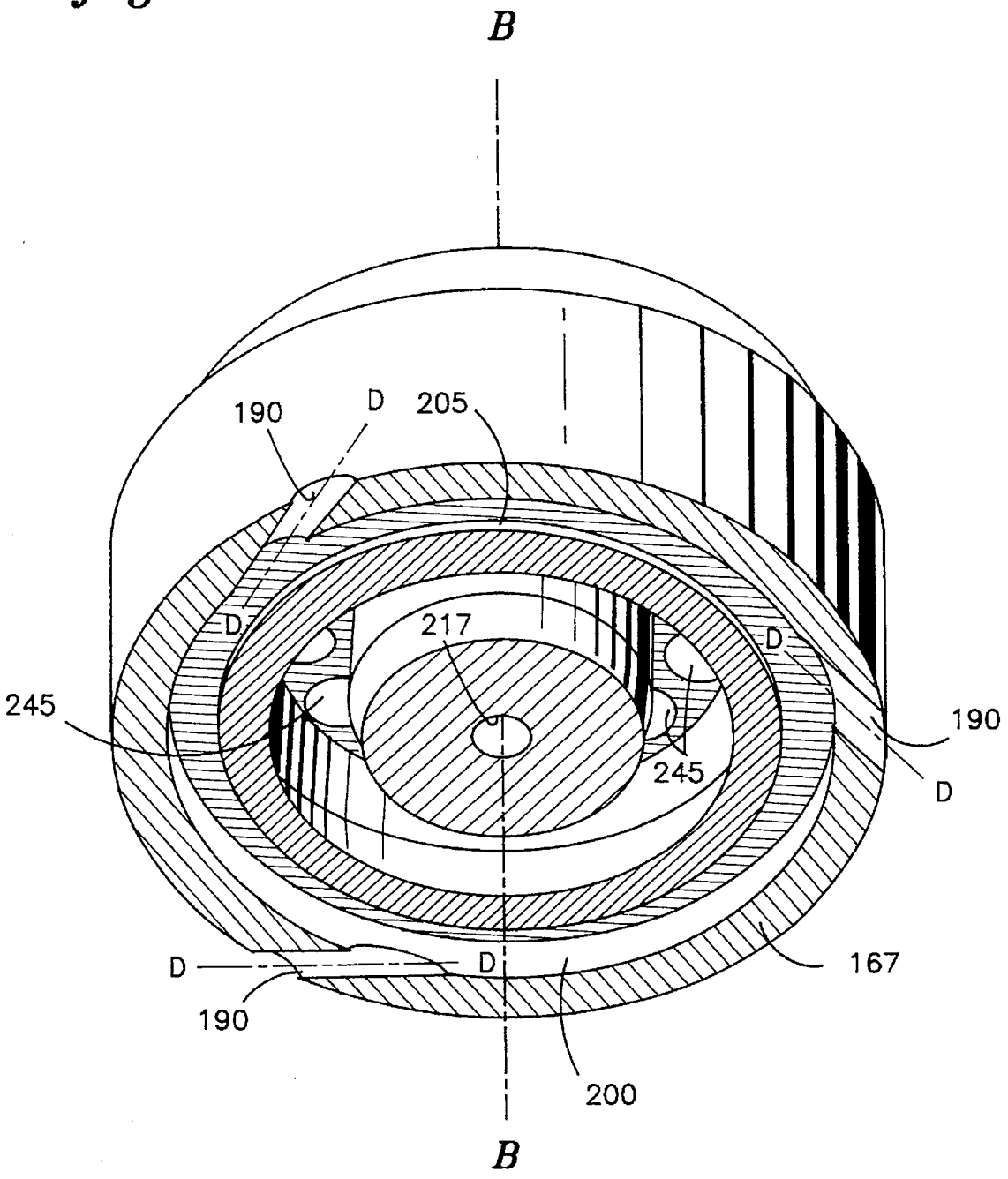
FIG. 3 is a cross-sectional view taken along the lines 3—3 of FIG. 2.

FIG. 3 shows a cross sectional view through the tip assembly 60 along the lines 3—3 of FIG. 2. Referring to FIG. 3, the metering holes 190 are shown as each having an axis D—D,D'—D' and D"—D", each of which is tangential to the surface 200 of the gallery wall 167. Because the surfaces 200 and 205 converge towards each other, and towards the axis B—B of the tip 60, fuel spins in a helical fashion in the downstream direction through the gallery 185, eventually passing the fuel pinch point 207 where it is contacted by streams of air passing through the nozzle 18.

As additionally shown in FIG. 2, the tip assembly 60 includes a pair of radially spaced apart air passages 217 and 220 for flowing air in a downstream direction through the tip 60. An inner air passage 217 is constructed and arranged to produce a jet of air which flows along the axis B—B of the tip 60. The first passage 217 preferably has a circular cross sectional shape, and the diameter of the first passage 217 decreases in the axially downstream direction. The second air passage 220 is radially outward of the first, inner air passage 217. The outer passage 220 has an annular shape and is coaxial with the first air passage 217. Preferably, and as shown in FIG. 2, the passages 217, 220 merge together upstream of the fuel pinch point 207.

The radially outer boundary of the inner air passage 217 is defined by the inner surface 219 of wall 221. The radially outer boundary of the outer air passage 220 is defined by the inner surface 235 of wall 206; and the radially inner boundary of the outer air passage is defined by the outer surface 240 of wall 221.

Air enters the second air passage 220 through a plurality of circumferentially spaced apart metering holes 245 near the upstream end 150 of the tip 60. The axis of these air holes 245 is tangential to the axis B—B of the tip 60. The holes 245 merge with each other to form the annular shaped air passage 220 which extends in the downstream direction through the tip 60 as described above. Air flowing through passage 220 has a tangential component of velocity, as a result of the metering holes 245 being drilled at an angle with respect to the axis of the tip and at a radius from the tip central line. Further, and as described above, the first and second air passages 217 and 220 merge to form core tip air within the nozzle 18. As a result, and generally speaking, air flowing through passages 217 and 220 is in the form of a continuous film as a result of the decreasing diameter of the passage 220.

During operation of the fuel nozzle of this invention, fuel passes into the tip assembly 60 through the fuel passage 135 in the stem 55. Before reaching the tip 60, fuel passes through a fuel restrictor 148 and a fuel filter 146, both positioned within the fuel passage 135. The fuel passes into the fuel gallery 185 from the annular shaped fuel channel 140 by means of the metering holes 190. The fuel passage 135 and fuel channel 142 are constructed and arranged to deliver fuel to the tip 60 at the most downstream location of the nozzle 18 as possible. Such a design minimizes the possibility that coking of fuel will take place within the nozzle 18. Coking is a problem with many prior art nozzles, which are characterized by intricate passages for flowing fuel from the upstream end of the fuel tip to the downstream end of the tip. As is seen in FIG. 2, fuel passes nearly directly from the fuel manifold to the fuel gallery 185. The metering holes 190, through which fuel flows from the fuel channel 140 to the fuel gallery 185, are drilled tangentially to the outer diameter surface 200 of the fuel gallery 185. The construction and arrangement of such holes 185 imparts a swirl component to the fuel as it flows in the downstream direction. If the particular operating characteristics of the fuel nozzle demand it, the holes 190 can have an axially directed component. Fuel in the fuel gallery 185 flows in a helical path in the downstream direction to the pinch point 207. Upon reaching the pinch point 207, the fuel is contacted by air flowing through the tip 60 and through the stem 55. In particular, the fuel first comes in contact with air flowing through the air passages 217 and 220 of the tip 60. As the fuel contacts such air, it floats on the surface of the air, and is stretched by shear stresses generated by the air, which flows through the tip at high velocities. Fuel is also accelerated out of the tip assembly 60 as a result of the low pressure created by air passing thorough the tip holes 145. The combination of high velocity air passing on both sides of the fuel film results in the film being squeezed as it exits the nozzle. The squeezing action accelerates the film and reduces its thickness to a point where eventually the film is atomized to produce film droplets that are required for efficient combustion. Backflow of fuel into the nozzle 18 is prevented by air flowing through the central jet region 217 of the tip 60.

The fuel nozzle of the present invention provides significant improvements to the state of the art. It allows for the efficient combustion of fuel, which not only is cost effective, but also environmentally responsible. The inventive nozzle is especially useful in the small gas turbine engine marketplace.

Although the invention has been shown and described with respect to a particular embodiment thereof, it should be understood by those skilled in the art that the foregoing and various other changes, omissions, and additions in the form and detail thereof may be made therein without departing from the spirit and scope of the invention.

We claim:

1. A gas turbine engine fuel nozzle having an upstream end, a downstream end, and an axis, comprising:

a nozzle stem;

a nozzle tip assembly, wherein said tip assembly is sealingly and releasably engaged within said stem;

a nozzle sheath surrounding said stem and tip assembly; wherein said nozzle comprises first and second air passages extending downstream therethrough, said first air passage having an annular, radially inwardly converging cross sectional shape, and said second air passage is defined by a plurality of circumferentially spaced apart holes extending through said stem, said holes spaced radially outwardly of said first air passage;

wherein said nozzle further comprises a fuel gallery extending downstream therethrough, said fuel gallery having an annular, radially inwardly converging cross sectional shape defined by opposing and radially inwardly converging surfaces, and wherein said fuel gallery is spaced radially intermediate said first and second air passages;

means constructed and arranged to flow fuel into said fuel gallery at an angle substantially tangential to the surfaces defining said gallery; and wherein said sheath includes inlet means for admitting air into said sheath, and outlet means for flowing air and fuel out of said sheath.

2. The fuel nozzle of claim 1, wherein said tip assembly is engaged within said stem by a spring clip secured within a notch extending circumferentially in said stem.

3. The fuel nozzle of claim 1, wherein said nozzle stem is sealingly and releasably engaged within said nozzle sheath.

4. The fuel nozzle of claim 3, wherein said stem and sheath abut each other along surfaces that extend along the axis of said nozzle.

5. A gas turbine engine fuel nozzle having an upstream end, a downstream end, and an axis, comprising:

a nozzle stem;

a nozzle tip assembly;

a nozzle sheath surrounding said stem and tip assembly;

wherein said nozzle comprises first and second air passages extending downstream therethrough, said first air passage having an annular, radially inwardly converging cross sectional shape, and said second air passage is defined by a plurality of circumferentially spaced apart holes extending through said stem, said holes spaced radially outwardly of said first air passage;

wherein said nozzle further comprises a fuel gallery extending downstream therethrough, said fuel gallery having an annular, radially inwardly converging cross sectional shape defined by opposing and radially inwardly converging surfaces, and wherein said fuel gallery is spaced radially intermediate said first and second air passages;

means constructed and arranged to flow fuel into said fuel gallery at an angle substantially tangential to the surfaces defining said gallery, wherein said means for flowing fuel into said fuel gallery comprises an annular fuel channel spaced radially outwardly of said fuel gallery, and a plurality of metering hole extending between said fuel gallery and fuel channel; and wherein said sheath includes inlet means for admitting air into said sheath, and outlet means for flowing air and fuel out of said sheath.

6. The fuel nozzle of claim 5, wherein said metering holes have an axis tangential to one of said surfaces defining said fuel gallery.

7. The fuel nozzle of claim 5, wherein said means for flowing fuel into said fuel gallery further comprises a fuel passage extending from a fuel manifold to said fuel channel.

8. A gas turbine engine fuel nozzle having an upstream end, a downstream end, and an axis, comprising:

a nozzle stem;

a nozzle tip assembly;

a nozzle sheath surrounding said stem and tip assembly;

wherein said nozzle comprises first and second air passages extending downstream therethrough, said first air passage having an annular, radially inwardly converging cross sectional shape, and said second air passage is defined by a plurality of circumferentially spaced apart holes extending through said stem, said holes spaced radially outwardly of said first air passage;

wherein said nozzle further comprises extending downstream therethrough, said fuel gallery having an annular, radially inwardly converging cross sectional shape defined by opposing and radially inwardly converging surfaces, and wherein said fuel gallery is spaced radially intermediate said first and second air passages;

means constructed and arranged to flow fuel into said fuel gallery at an angle substantially tangential to the surfaces defining said gallery; and wherein said sheath includes inlet means for admitting air into said sheath, wherein said means for admitting air into said sheath includes a plurality of holes extending through the wall of said sheath, and outlet means for flowing air and fuel out of said sheath.

9. A gas turbine engine fuel nozzle having an upstream end, a downstream end, and an axis, comprising:

a nozzle stem;

a nozzle tip assembly; and a nozzle sheath surrounding said stem and tip;

wherein said nozzle comprises first, second and third air passages extending downstream therethrough, said first air passage having an annular cross sectional shape defined by opposing and radially inwardly converging surfaces of said tip, said second air passage is defined by a plurality of circumferentially spaced apart holes extending through said stem, said holes having a circular cross sectional shape spaced radially outwardly of said first air passage, and said third air passage has a circular cross sectional shape, wherein said first and third air passages merge within said tip assembly;

wherein said nozzle further comprises a fuel gallery extending downstream therethrough, said fuel gallery having an annular cross sectional shape defined by opposing and radially inwardly converging surfaces, and wherein said fuel gallery is spaced radially intermediate said first and second air passages;

a fuel channel radially outward of said fuel gallery;

a plurality of metering holes extending between said fuel channel and said fuel gallery, each of said holes having an axis tangential to one of the surfaces of said gallery; and wherein said sheath includes a plurality of inlet means for admitting air into said sheath, and a singular outlet means for flowing air and fuel out of said sheath.

10. A gas turbine engine fuel nozzle with an upstream end and a downstream end, said nozzle having a nozzle stem;

a nozzle sheath surrounding said stem, said sheath having inlet means for admitting air into said sheath and outlet means for flowing air and fuel out of said sheath;

a first air passage in flow communication with air admitted into said sheath, said first air passage extending downstream through said nozzle to said outlet means, said first air passage having an annular, radially inwardly converging cross sectional shape;

a second air passage in flow communication with air admitted into said sheath, said second air passage extending downstream through said nozzle to said outlet means, said second air passage spaced radially outwardly of said first air passage; and a fuel gallery with an annular, radially inwardly converging cross sectional shape defined by opposing and radially inwardly converging surfaces, said fuel gallery having means constructed and arranged to flow fuel into said fuel gallery at an angle substantially tangential to the surfaces defining said gallery, said fuel gallery spaced radially intermediate said first and second air passages to deliver said fuel flow therebetween;

wherein said second air passage comprises a plurality of circumferentially spaced apart holes constructed and arranged such that air having been discharged from said nozzle there through imparts an axial, radial and tangential component of momentum to fuel and air delivered from said fuel gallery and said first air passage.

11. The fuel nozzle of claim 10 also comprising a nozzle tip assembly, said sheath surrounding said stem and said tip assembly, wherein said tip assembly is sealingly and releasably engaged within said stem.

12. The fuel nozzle of claim 11 wherein said tip assembly is engaged within said stem by a spring clip secured within a notch extending circumferentially in said stem.

13. The fuel nozzle of claim 11 wherein said nozzle stem is sealingly and releasably engaged within said nozzle sheath.

14. The fuel nozzle of claim 13 wherein said stem and sheath abut each other along surfaces that extend along the axis (N—N) of said nozzle.

15. The fuel nozzle of claim 10 wherein said means for flowing fuel into said fuel gallery comprises an annular fuel channel spaced radially outwardly of said fuel gallery and a plurality of metering holes extending between said fuel gallery and fuel channel.

16. The fuel nozzle of claim 15 wherein said metering holes have an axis (B—B) tangential to one of said surfaces defining said fuel gallery.

17. The fuel nozzle of claim 15 wherein said means for flowing fuel into said fuel gallery further comprises a fuel passage extending from a fuel manifold to said fuel channel.

18. The fuel nozzle of claim 10 wherein said inlet means for admitting air into said sheath includes a plurality of holes extending through the wall of said sheath.

19. The fuel nozzle of claim 10 further comprising a third air passage having a circular cylindrical shape, said third air passage merging with said first air passage within said tip assembly.

20. The fuel nozzle of claim 10 wherein each of said plurality of circumferentially spaced apart holes has a circular cross sectional shape.

21. A gas turbine engine fuel nozzle having an upstream end, a downstream end, and an axis, comprising:

a nozzle stem;

a nozzle tip assembly; and a nozzle sheath surrounding said stem and tip assembly;

wherein said nozzle comprises first and second air passages extending downstream therethrough, said first air passage having, toward said downstream end, an annular, radially inwardly converging cross sectional shape, and said second air passage is defined by a plurality of circumferentially spaced apart holes extending through said stem, said passages spaced radially outwardly of said first air passage;

wherein said nozzle further comprises a fuel gallery extending downstream therethrough, said fuel gallery having, toward said downstream end, an annular, radially inwardly converging cross sectional shape defined by opposing and radially inwardly converging surfaces, and wherein said fuel gallery is spaced radially intermediate said first and second air passages;

means constructed and arranged to flow fuel into said fuel gallery at an angle substantially tangential to the surface defining said gallery; and wherein said sheath includes inlet means for admitting air into said sheath, and outlet means for flowing air and fuel out of said sheath.

22. The fuel nozzle of claim 21, wherein said tip assembly is sealingly and releasably engaged within said stem.

23. The fuel nozzle of claim 22, wherein said tip assembly is engaged within said stem by a spring clip secured within a notch extending circumferentially in said stem.

24. The fuel nozzle of claim 22, wherein said nozzle stem is sealingly and releasably engaged within said nozzle sheath.

25. The fuel nozzle of claim 24, wherein said stem and sheath abut each other along surfaces that extend along the axle of said nozzle.

* * * * *

UNITED STATES PATENT AND TRADEMARK OFFICE

CERTIFICATE OF CORRECTION

PATENT NO. : 5,579,645
DATED : Dec. 3, 1996
INVENTOR(S) : Lev A. Prociw, et al.

It is certified that error appears in the above-identified patent and that said Letters Patent is hereby corrected as shown below:

In the claims:

claim 8, column 7, line 4, after "comprises" insert --a fuel gallery-- claim 9, column 7, line 21, after "assembly;" delete --and-- claim 21, column 9, line 6, delete "surface" and insert --surfaces-- claim 25, column 10, line 9, delete "axle" and insert --axis--

Signed and Sealed this

Eighteenth Day of May, 1999

*Attest:*

Q. TODD DICKINSON

*Attesting Officer*

*Acting Commissioner of Patents and Trademarks*